US010317113B2

(12) United States Patent
Song et al.

(10) Patent No.: US 10,317,113 B2
(45) Date of Patent: Jun. 11, 2019

(54) AIR CONDITIONER

(71) Applicant: LG ELECTRONICS INC., Seoul (KR)

(72) Inventors: Chiwoo Song, Seoul (KR); Pilhyun Yoon, Seoul (KR); Kakjoong Kim, Seoul (KR); Jaehwa Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 267 days.

(21) Appl. No.: 15/296,649

(22) Filed: Oct. 18, 2016

(65) Prior Publication Data

US 2017/0108250 A1 Apr. 20, 2017

(51) Int. Cl.
*F25B 5/02* (2006.01)
*F25B 6/04* (2006.01)
(Continued)

(52) U.S. Cl.
CPC ..... *F25B 13/00* (2013.01); *F25B 5/02* (2013.01); *F25B 6/04* (2013.01); *F25B 41/003* (2013.01); *F25B 49/02* (2013.01); *F25B 2313/007* (2013.01); *F25B 2313/021* (2013.01); *F25B 2313/023* (2013.01); *F25B 2313/0252* (2013.01); *F25B 2313/0253* (2013.01); *F25B 2313/0254* (2013.01); *F25B 2341/066* (2013.01); *F25B 2400/0409* (2013.01); *F25B 2400/23* (2013.01); *F25B 2500/28* (2013.01);
(Continued)

(58) Field of Classification Search
CPC ..... F25B 2600/2501; F25B 2500/28; F25B 2600/2503; F25B 6/04; F25B 6/02; F24F 1/06
See application file for complete search history.

(56) References Cited

FOREIGN PATENT DOCUMENTS

CN 1280278 1/2001
CN 103348197 10/2013
(Continued)

OTHER PUBLICATIONS

English Translation of KP10-2014-0093449, Lee et al., published Jul. 28, 2014 (Year: 2014).*
(Continued)

*Primary Examiner* — Cassey D Bauer
(74) *Attorney, Agent, or Firm* — Ked & Associates LLP

(57) ABSTRACT

An air conditioner is provided that may include at least one compressor that compresses a refrigerant to a high pressure; a plurality of heat exchanger that condenses the refrigerant compressed in the at least one compressor; a plurality of outdoor valves, respectively, provided at an outlet side pipe of the plurality of heat exchangers; a gas liquid separator that separates the refrigerant into gas and liquid refrigerants and supplies the gas refrigerant to the at least one compressor; and one or more bypass devices connected to the outlet side pipe of one or more of the plurality of heat exchangers and an inlet side pipe of the gas liquid separator, the one or more bypass devices controlling a flow of the liquid refrigerant. During a cooling low load operation in which a portion of the plurality of heat exchangers is operating, a liquid refrigerant loaded into a heat exchanger of the plurality of heat exchangers, which is not operated, may flow through the one or more bypass device.

8 Claims, 3 Drawing Sheets

(51) Int. Cl.
*F25B 13/00* (2006.01)
*F25B 41/00* (2006.01)
*F25B 49/02* (2006.01)

(52) U.S. Cl.
CPC ..... *F25B 2600/2501* (2013.01); *F25B 2600/2503* (2013.01)

(56) References Cited

FOREIGN PATENT DOCUMENTS

| | | |
|---|---|---|
| CN | 103597296 | 2/2014 |
| CN | 104704301 | 6/2015 |
| CN | 104713195 | 6/2015 |
| DE | 3030754 | 2/1982 |
| DE | 11 2013 004 919 | 7/2015 |
| EP | 2 730 859 | 5/2014 |
| EP | 2 886 977 | 6/2015 |
| KR | 10-0812780 | 3/2008 |
| KR | 10-2012-0018354 | 9/2013 |
| KR | 10-2014-0093449 | 7/2014 |
| WO | WO 2014/057607 | 4/2014 |

OTHER PUBLICATIONS

Korean Office Action dated Aug. 4, 2016 issued in Application No. 10-2015-0145399.
European Search Report dated Feb. 28, 2017 issued in Application No. 16188483.8.
Chinese Office Action dated Aug. 23, 2018 with English Translation.

* cited by examiner

AIR CONDITIONER

CROSS-REFERENCE TO RELATED APPLICATION(S)

The present application claims priority under 35 U.S.C. 119 and 35 U.S.C. 365 to Korean Patent Application No. 10-2015-0145399, filed in Korea on Oct. 19, 2015, which is hereby incorporated by reference in its entirety.

BACKGROUND

1. Field

An air conditioner is disclosed herein.

2. Background

An air conditioner is a device that maintains air in a predetermined area in a most suitable state according to a use and purpose. In general, the air conditioner includes a compressor, a condenser, an expansion device, and an evaporator. A refrigeration cycle that performs a process of compression, condensation, expansion, and evaporation of a refrigerant is driven in the air conditioner to cool or heat the predetermined area.

The predetermined area may be a variety of areas depending on a place in which the air conditioner is used. For example, when the air conditioner is provided in a home or office, the predetermined area may be an interior space of a house or building. On the other hand, when the air conditioner is provided in a vehicle, the predetermined area may be a space in which a person rides.

When the air conditioner performs a cooling operation, an outdoor heat exchanger provided in an outdoor unit or device performs a condenser function, and an indoor heat exchanger provided in an indoor unit or device performs an evaporator function. On the other hand, when the air conditioner performs a heating operation, the indoor heat exchanger performs the condenser function and the outdoor heat exchanger performs the evaporator function.

FIG. 1 is a block diagram of a related art air conditioner. Referring to FIG. 1, a related art air conditioner 10 may perform a cooling or heating operation only, or may perform the cooling and the heating operation at the same time. The related art air conditioner 10 includes an outdoor unit or device 11 including a compressor and an outdoor heat exchanger, a distribution unit or distributor 12 connected with the outdoor unit 11 and one or more indoor units or devices 13, 14, and 15, respectively, connected with the distributor 12 and including an indoor heat exchanger. The one or more indoor devices 13, 14, and 15, may include a first indoor unit or device 13, a second indoor unit or device 14, and a third indoor unit or device 15.

To perform a cooling or heating operation only means that all of the indoor devices are cooling-operated or heating-operated. This operation mode may be referred to as a "cooling-only operation" or "heating-only operation".

To perform the cooling and heating operation at the same time means that a part or portion of the one or more indoor devices is cooling-operated, and the rest of the one or more indoor devices may be heating-operated. This operation mode may be referred to as a "simultaneous cooling and heating operation" or "co-type operation". In the case of the "simultaneous cooling and heating operation", an operation mode when more indoor devices of the one or more indoor devices perform the cooling operation is defined as a "principal cooling operation", and an operation mode when more indoor devices of the one or more indoor devices perform the heating operation is defined as a "principal heating operation".

The distributor 12 is a device that distributes a refrigerant discharged from the outdoor device 11 to the one or more indoor devices 13, 14, and 15, or supplies a refrigerant discharged from the one or more indoor devices 13, 14, and 15 to the outdoor device 11 again. The distributor 12 may be connected to the outdoor device 11 through three pipes 16, 17, and 18. The three pipes 16, 17, and 18 may include a high pressure pipe 16, a low pressure pipe 17, and a liquid pipe 18.

The high pressure pipe 16 is a pipe through which a refrigerant flows in a gaseous state of high temperature and high pressure before being introduced to the condenser after being compressed in the compressor. The low pressure pipe 17 is a pipe through which a refrigerant flows until introduced to the compressor in a gaseous state of low temperature and low pressure after being evaporated in the evaporator. The liquid pipe 18 is a pipe through which a high temperature and high pressure liquid refrigerant condensed by the condenser flows.

A structure of a distributor of an air conditioner is disclosed in Korean Application No. 10-2012-0018354, published in Korea on Sep. 2, 2013 and entitled "air conditioner", which is hereby incorporated by reference. With such a related art air conditioner, there is the following problem. When an outdoor device is connected to a plurality of indoor devices with a single heat exchange portion or heat exchanger, as the heat exchange portion is overloaded in order to supply a desired cooling or heating temperature to an indoor space, there is a problem that durability of the heat exchange portion is degraded such that it is easily broken and must be repaired frequently.

BRIEF DESCRIPTION OF THE DRAWINGS

Embodiments will be described in detail with reference to the following drawings in which like reference numerals refer to like elements, and wherein.

DETAILED DESCRIPTION

Figure 1:
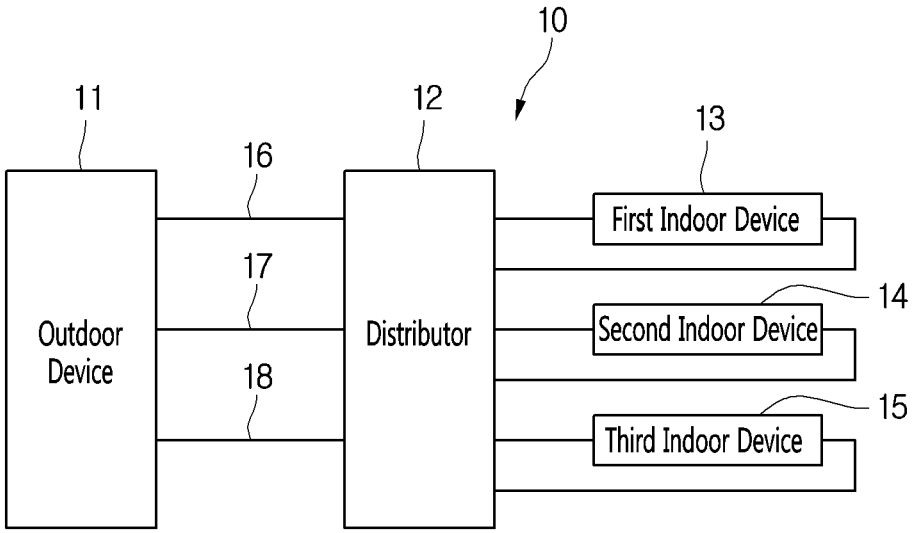
FIG. 1 is a block diagram of a related art air conditioner.

Reference will now be made in detail to embodiments, examples of which are illustrated in the accompanying drawings. Where possible, like reference numerals have been used to indicate like element and repetitive disclosure has been omitted.

In the following description of embodiments, reference is made to the accompanying drawings that form a part hereof, and in which is shown by way of illustration embodiments which may be practiced. These embodiments are described in sufficient detail to enable those skilled in the art to practice the embodiments, and it is understood that other embodiments may be utilized and that logical structural, mechanical, electrical, and chemical changes may be made without departing from the spirit or scope. To avoid detail not necessary to enable those skilled in the art to practice the embodiments, the description may omit certain information known to those skilled in the art. The following description is, therefore, not to be taken in a limiting sense.

Also, in the description of embodiments, terms such as first, second, A, B, (a), (b) or the like may be used herein when describing components of the embodiments. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 2:
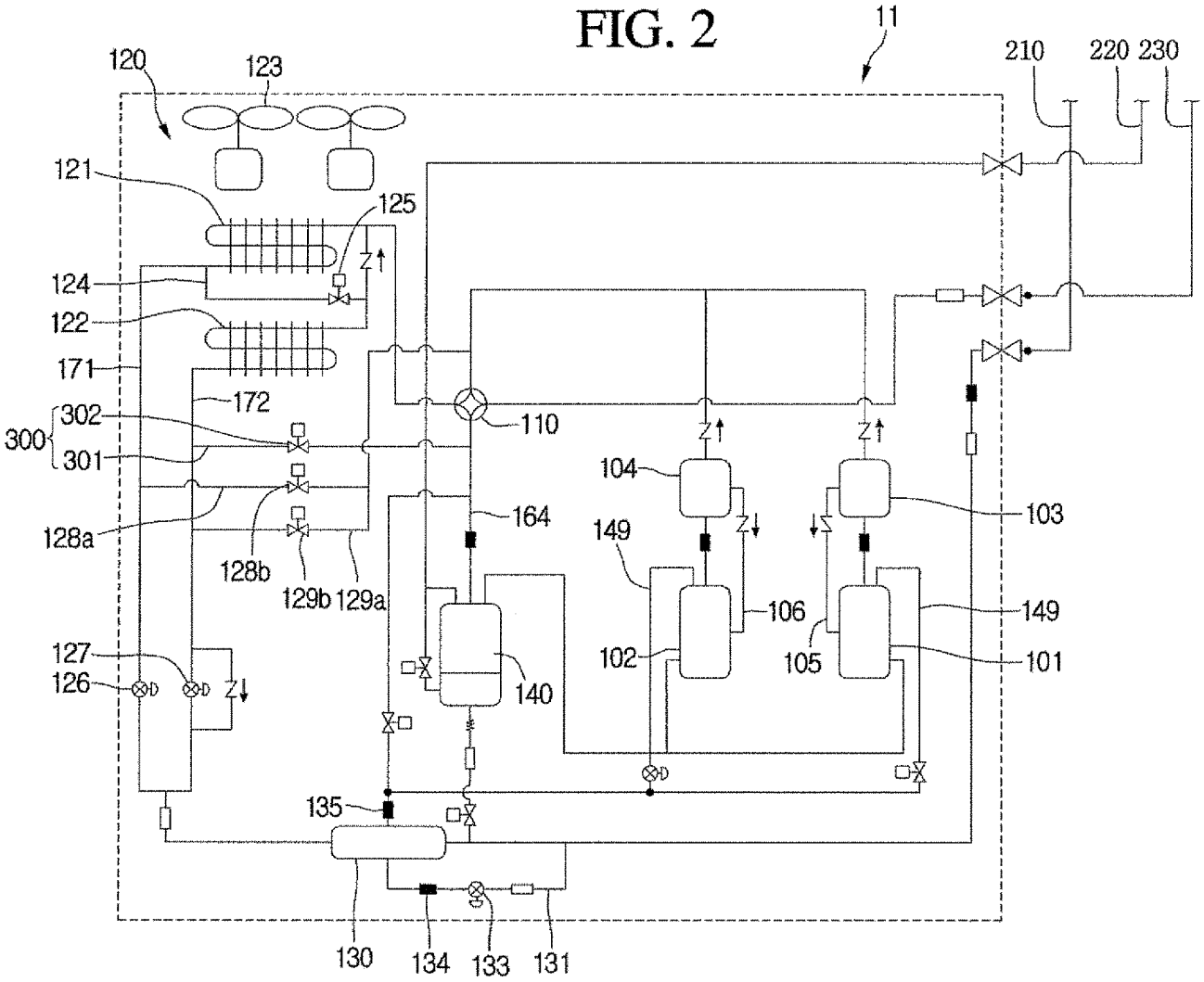
FIG. 2 is a schematic diagram of an air conditioner according to an embodiment.

FIG. 2 is a schematic diagram of an air conditioner according to an embodiment. Referring to FIG. 2, an air conditioner according to an embodiment may include an outdoor unit or device 11 disposed or provided at an outside and an indoor unit or device disposed or provided inside. The indoor device may include an indoor heat exchanger that heat-exchanges with air in an indoor space.

The outdoor device 11 may include a plurality of compressors 101 and 102, and oil separators 103 and 104 disposed or provided at outlet sides of the plurality of compressors 101 and 102. The oil separates 103 and 104 may separate oil from a refrigerant discharged from the plurality of compressors 101 and 102, respectively.

The plurality of compressors 101 and 102 may include a first compressor 101 and a second compressor 102, which may be connected in parallel. The first compressor 101 may be a main compressor and the second compressor 102 may be a sub compressor.

According to a capacity of the air conditioner, the first compressor 101 may be operated first and when a capacity of the first compressor 101 is not sufficient, the second compressor 102 may be additionally operated. For example, an inverter compressor may be included in the first compressor 101 and the second compressor 102.

The oil separators 103 and 104 may include a first oil separator 103 disposed or provided at an outlet side of the first compressor 101, and a second oil separator 104 disposed or provided at an outlet side of the second compressor 102.

The outdoor device 11 may include a first collection flow path 105 and a second collection flow path 106 that, respectively, collect the oil from the first and second oil separators 103 and 104 to the first and second compressors 101 and 102. That is, the first collection flow path 105 may extend from the first oil separator 103 to the first compressor 101, and the second collection flow path 106 may extend from the second oil separator 104 to the second compressor 102.

A check valve that guides a one way refrigerant flow from the first and second oil separators 103 and 104 to the first and second compressors 101 and 102 may be, respectively, installed at or on the first and second collection flow paths 105 and 106. A flow switch 110 that guides a refrigerant compressed and discharged from the first and second compressors 101 and 102 to an outdoor heat exchanger 120 or an indoor device may be provided on outlet sides of the first and second oil separators 103 and 104.

When the air conditioner performs a cooling operation, a refrigerant may be introduced from the flow switch 110 to the outdoor heat exchanger 120. On the other hand, when the air conditioner performs a heating operation, a refrigerant may flow toward the indoor heat exchanger of the indoor device via the flow switch 110 through a high pressure pipe 230.

The outdoor heat exchanger 120 may include a plurality of heat exchangers 121 and 122 and one or more outdoor fan 123. The plurality of heat exchangers 121 and 122 may include a first heat exchanger 121 and a second heat exchanger 122, which may be connected in parallel. A refrigerant passing through the flow switch 110 may be directed to flow toward the first heat exchanger 121 by the flow switch 110, and it may be introduced into the first heat exchanger 121.

The outdoor heat exchanger 120 may include a variable flow path 124 that guides a refrigerant from an outlet side of the first heat exchanger 121 to an inlet side of the second heat exchanger 122. The variable flow path 124 may extend from an outlet side pipe 171 of the first heat exchanger 121 to an inlet side pipe of the second heat exchanger 122.

A variable valve 125 provided on the variable flow path 124 that selectively blocks a flow of the refrigerant may be provided in the outdoor heat exchanger 120. Depending on an on/off state of the variable valve 125, the refrigerant passing through the first heat exchanger 121 may be selectively introduced to the second heat exchanger 122.

When the variable valve 125 is turned on or opened, the refrigerant passing through the first heat exchanger 121 may introduced into the second heat exchanger 122 via the variable flow path 124. At this time, a first outdoor valve 126 provided on or at the outlet side pipe 171 of the first heat exchanger 121 may be closed.

A second outdoor valve 127 may be provided on or at an outlet side pipe 172 of the second heat exchanger 122, and a refrigerant heat-exchanged at the second heat exchanger 122 may be introduced into a super cooling heat exchanger 130 through the opened second outdoor valve 127. On the other hand, when the variable valve 125 is turned off or closed, a refrigerant flow toward the second heat exchanger 122 may be restricted, and the refrigerant passing through the first heat exchanger 121 may be introduced into the super cooling heat exchanger 130 via the first outdoor valve 126. The first outdoor valve 126 and the second outdoor valve 127 may correspond to a placement of the first and second heat exchangers 121 and 122, and may be disposed or provided in parallel.

The outlet side pipe 171 of the first heat exchanger 121 and the outlet side pipe 172 of the second heat exchanger 122 may be connected with a first bypass pipe **128*a* and a second bypass pipe 129*a*. The first and second bypass pipes 128*a* and 129*a* may, respectively, extend from the flow switch 110 to the outlet side pipes 171 and 172 of the first heat exchanger 121 and the second heat exchanger 122, and may selectively bypass the high pressure refrigerant discharged from the first and second compressors 101 and 102 to the outlet sides of the first and second heat exchangers 121 and 122. A first bypass valve 128*b* and a second bypass valve 129*b*, opening degrees of which may be adjusted, may be respectively installed or provided in the first and second bypass pipes 128*a* and 129*a***.

The super cooling heat exchanger 130 may be disposed or provided in or at an outlet side of the outdoor heat exchanger 120. When the air conditioning system performs the cooling operation, a refrigerant passing through the outdoor heat exchanger 120 may be introduced into the super cooling heat exchanger 130. The super cooling heat exchanger 130 may be understood as an apparatus in which a liquid refrigerant circulating in the refrigerant system and an intermediate heat exchanger exchange heat after a portion of the refrigerant (separated refrigerant) is branched.

The outdoor device 11 may include a super cooling flow path 131, through which the separated refrigerant may be branched. In addition, a super cooling expansion device 133 that decompresses the separated refrigerant may be provided on the super cooling flow path 131. The super cooling expansion device 133 may include an EEV (Electric Expansion Valve).

A plurality of super cooling sensors 134 and 135 may be provided in the super cooling flow path 131. The plurality of super cooling sensors 134 and 135 may include a first super cooling sensor 134 that senses a temperature of the refrigerant before the refrigerant is introduced into the super cooling heat exchanger 130, and a second super cooling sensor 135 that senses a temperature of the refrigerant after the refrigerant has passed through the super cooling heat exchanger 130.

A "super cooling degree value" may be based on a temperature value of the refrigerant, respectively, sensed by the first super cooling sensor 134 and the second super cooling sensor 135. For example, a value obtained by subtracting a temperature value sensed by the second super cooling sensor 135 from a temperature value sensed by the first super cooling sensor 134 may be recognized as the "super cooling degree value".

The separated refrigerant heat-exchanged in the super cooling heat exchanger 130 may be introduced into a gas liquid separator 140 or the compressors 101 and 102. The gas liquid separator 140 may be configured so that a gas refrigerant may be separated before the refrigerant is introduced into the compressors 101 and 102. A gas refrigerant of a refrigerant introduced into the gas liquid separator 140 through a low pressure flow path 164 may be suctioned in the first and second compressors 101 and 102 via a suction flow path 149. The pressure of the refrigerant suctioned into the first and second compressors 101 and 102 (hereinafter, "a suctioned pressure") may be a low pressure.

A liquid refrigerant passing through the super cooling heat exchanger 130 may be introduced into the indoor device through a liquid pipe 210. Unexplained reference numeral 220 is a low pressure pipe.

In addition, a bypass unit or device 300 may be disposed or provided between the outlet side pipe 172 of the second heat exchanges 122 and the low pressure flow path 164. The bypass device 300 may direct a refrigerant in the second heat exchanger 122 to the gas liquid separator 140 when the variable valve 125 is off or closed.

The bypass device 300 may include a bypass collection flow path 301, ends of which may be connected to the outlet side pipe 172 of the second heat exchanger 122 and the low pressure flow path 164 bypass, and a bypass valve 302 disposed or provided in the bypass collection flow path 301 to open and close the bypass collection flow path 301. An operation of the bypass device 300 will be described hereinbelow.

Hereinafter, a flow of refrigerant during a cooling low load operation of the air conditioner according to an embodiment will be described.

When the variable valve 125 is turned on or opened, all of a refrigerant compressed by the compressors 101 and 102 may pass to the second heat exchanger 122 through the first heat exchanger 121 and the variable flow path 124 and may be heat-exchanged. In this case, all of the first outdoor valve 126 and the second outdoor valve 127 may be turned on or opened.

Therefore, as the refrigerant is supplied to the super cooling exchanger 130, a normal cycle may be formed. This cycle may be referred to as a "general cooling operation". In the general cooling operation, the liquid refrigerant does not flow through the bypass device 300. The bypass valve 302 of the bypass device 300 may be maintained in a closed state.

When the variable valve 125 is turned off or closed, the refrigerant compressed by the compressors 101 and 102 only passes through the first heat exchanger 121. The first outdoor valve 126 is turned on or opened and the second outdoor valve 127 is turned off or closed. In addition, the refrigerant passing through the first heat exchanger 121 is supplied to the super cooling heat exchanger 130 through the first outdoor valve 126, so that a cooling cycle may be formed. This is, when a low temperature cooling is not required in the inside, by using only the first heat exchanger 121 of the plurality of heat exchangers 121 and 122, a load of the second heat exchanger 122 may be reduced. This cycle may be referred to as a "cooling low load operation".

Figure 3:
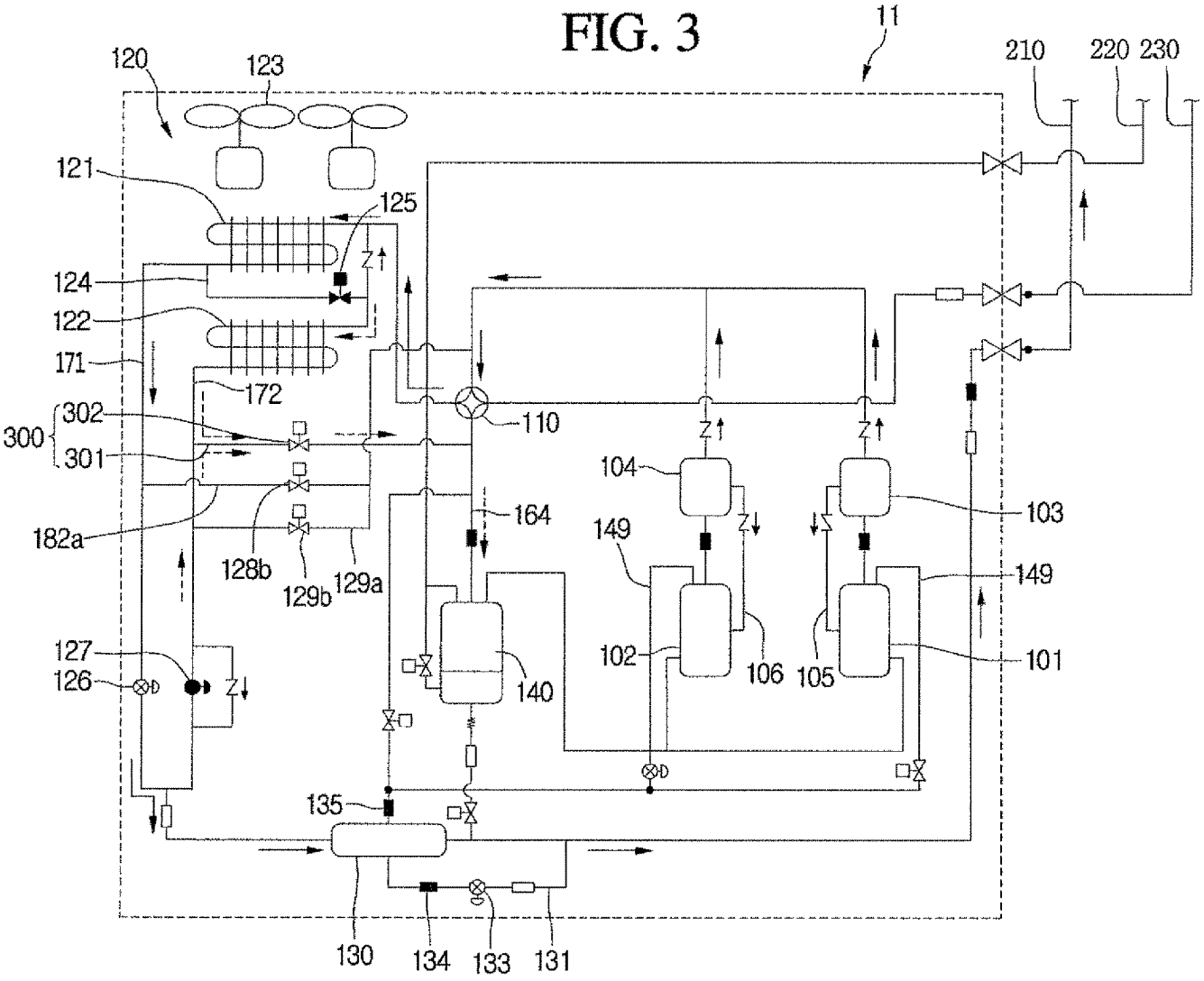
FIG. 3 is a schematic diagram illustrating a cooling low temperature cycle operation of the air conditioner according to an embodiment.

FIG. 3 is a schematic diagram illustrating a refrigerant flow during a cooling low load operation of the air conditioner according to an embodiment. When the cooling low load operation is performed, the variable valve 125 is turned off or closed, also the second outdoor valve 127 is turned off or closed, and the first outdoor valve 126 is turned on or opened. Simultaneously, the bypass valve 302 of the bypass device 300 may be turned on or opened.

Accordingly, a liquid refrigerant compressed by at least one of the first compressor 101 or the second compressor 102 may be introduced into the first heat exchanger 121 via the flow switch 110. In addition, as the variable valve 125 is turned off or closed, the liquid refrigerant is not introduced into the second heat exchanger 122 and may flow to the super cooling heat exchanger 130 through the first outdoor valve 126. In this case, as the second outdoor valve 127 is turned off or closed, a refrigerant passing through the first outdoor valve 126 is not introduced to the second heat exchanger 122 through the second outdoor valve 127. Simultaneously, a liquid refrigerant which has been condensed and loaded in the second heat exchanger 122 and the outlet side pipe 172 may be introduced to the gas liquid separator 140 through the low pressure flow path 164 along the bypass collection flow path 301 by turning on or opening the bypass valve 302.

As the loaded liquid refrigerant is condensed and a high pressure refrigerant is formed, when the bypass valve 302 is opened, the liquid refrigerant moves to the bypass collection flow path 301 by a pressure difference between the second heat exchanger 122 and the gas liquid separator 140. Accordingly, the liquid refrigerant loaded in the second heat exchanger 122 and the outlet side pipe 172 may be used for a cooling or heating cycle at a later time.

That is, a problem in that the refrigerant loaded in the second heat exchanger 122 and the outlet side pipe 172 of the heat exchanger 122 causes an amount of the refrigerant used for a cooling or heating operation at a later time to be insufficient, and thus, a cooling and heating efficiency is excessively reduced may be solved. Accordingly, by using the loaded liquid refrigerant, there is an effect that the cooling and heating efficiency may be increased.

A case in which two heat exchangers is provided in the outdoor device is described as an example. When a plurality of heat exchangers is provided, a plurality of bypass devices may be provided as needed. That is, a configuration for realizing the spirit is not limited to the configuration according to the embodiments.

An air conditioner according to embodiments disclosed herein has at least the following advantages.

First, by using a portion or all of the plurality of heat exchangers, not only an indoor temperature may be controlled according to an environment and necessity, but also there is an effect that a load on the heat exchanger may be reduced. Second, when only using a portion of the plurality of heat exchangers, by circulating liquid refrigerant condensed and loaded in the unused heat exchanger to the gas liquid separator, embodiments may solve the problem that liquid refrigerant is loaded inside of the air conditioner. Third, by circulating the liquid refrigerant loaded in the unused heat exchanger, there is an effect of preventing cooling and heating efficiency from being reduced due to a lack of refrigerant.

Embodiments disclosed herein are configured with an air conditioner in which a plurality of heat exchangers is formed for solving the above problems. However, when using only a part or portion of the plurality of heat exchangers, problems such as leakage of a variable valve connected to an unused heat exchanger, a heat exchanger in which a condensed refrigerant is not used by repetition of an operation and operation stoppage of a condenser, and loading of such a refrigerant in a pipe occur.

An air conditioner according to embodiments disclosed herein solve the above problems.

An air conditioner according to embodiments may include a compressor that compresses a refrigerant to a high pressure; a plurality of heat exchange portions or heat exchangers that condenses the refrigerant compressed in the compressor; a plurality of outdoor valves formed or provided, respectively, on an outlet side pipe of the plurality of heat exchange portions; a gas liquid separator that separates the refrigerant into gas and liquid refrigerants and supplies the gas and liquid refrigerants to the compressor; and one or more bypass units or devices connected to the outlet side pipe of the plurality of heat exchange portions and an inlet side pipe of the gas liquid separator, and controlling a flow of a liquid refrigerant. During a cooling low load operation in which a portion of the heat exchange portion of the plurality of heat exchange portions is operating, a liquid refrigerant loaded in the heat exchange portion, which is not operated, flows through the bypass unit. In addition, during a general cooling operation in which all of the plurality of heat exchange portions are operating, a liquid refrigerant does not flow to or through the bypass unit.

The liquid refrigerant flowing through the bypass unit flows from the outlet side pipe of the plurality of heat exchange portions to the gas liquid separator. The bypass unit may include a bypass collection flow path connected to the outlet side pipe of the plurality of heat exchange portions and the inlet side pipe of the gas liquid separator, that supplies a flow path in which a liquid refrigerant may flow; and a bypass valve disposed or provided in the bypass collection flow path, that controls a flow of the flow path.

During the cooling low load operation, the bypass valve connected to an outlet side pipe of a non-operating heat exchange portion may be opened. During the general cooling operation in which all of the plurality of heat exchange portions are operating, the bypass valve may be closed.

During the cooling low load operation, a variable flow path that connects an outlet side pipe of an operating heat exchange portion and an inlet side pipe of a non-operating heat exchange portion, and that selectively allows flow of a liquid refrigerant may be further included. A variable valve that selectively opens and closes the variable flow path may be formed in the variable flow path.

During the cooling low load operation, an outdoor valve connected to the outlet side pipe of the operating heat exchange portion may be opened, an outdoor valve connected to the outlet side pipe of the non-operating heat exchange portion and the variable valve may be closed, and a bypass valve connected to the outlet side pipe of the non-operating heat exchange portion may be opened. The liquid refrigerant loaded in the non-operating heat exchange portion may flow to the gas liquid separator through the bypass collection flow path.

An air conditioner according to embodiments disclosed herein may include a compressor that compresses a refrigerant to a high pressure; a first heat exchange portion or heat exchanger that condenses the refrigerant compressed in the compressor; a second heat exchange portion or heat exchanger that condenses the refrigerant compressed in the compressor, and for which an operation is stopped during a cooling low load operation; a gas liquid separator that separates the refrigerant into gas and liquid refrigerants and supplies the gas and liquid refrigerants to the compressor; a bypass collection flow path that connects an outlet side pipe of the second heat exchange portion and an inlet side pipe of the gas liquid separator; and a bypass valve that opens or blocks the bypass collection flow path. During the cooling low load operation, the bypass valve may be opened and a liquid refrigerant loaded in the second heat exchange portion may flow to the gas liquid separator through the bypass collection flow path.

A variable flow path that connects an outlet side pipe of the first heat exchange portion and an inlet side pipe of the second heat exchange portion; and a variable valve that selectively blocks a refrigerant flow of the variable flow path may be further included. During the cooling low load operation, the variable valve may be closed and the refrigerant flow of the variable flow path may be blocked, so that a liquid refrigerant flow from the first heat exchange portion to the second heat exchange portion may be blocked.

A first outdoor valve disposed or provided in the outlet side pipe of the first heat exchange portion, and a second outdoor valve disposed or provided in the outlet side pipe of the second heat exchange portion may be further included. During the cooling low load operation, the first outdoor valve may be opened, and the second outdoor valve may be closed.

Even though all elements of embodiments are coupled into one or operated in a combined state, embodiments are not so limited. That is, all elements may be selectively combined with each other without departing from the scope. Further, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope as defined by the appended claims. Therefore, the embodiments should be considered in descriptive sense only and not for purposes of limitation, and also the technical scope is not limited to the embodiments. Further, the scope is defined not by the detailed description but by the appended claims, and all differences within the scope will be construed as being comprised in this disclosure.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

at least one compressor that compresses a refrigerant to a high pressure;

a plurality of heat exchangers that condenses the refrigerant compressed by the at least one compressor;

a plurality of outdoor valves, respectively, formed at an outlet side pipe of each of the plurality of heat exchangers;

a flow switch configured to guide the refrigerant compressed by the at least one compressor to the plurality of heat exchangers or an indoor device;

a gas liquid separator that separates the refrigerant into gas and liquid refrigerants and supplies the gas refrigerant to the at least one compressor;

a low pressure flow path through which a low pressure refrigerant discharged from the indoor device or the plurality of heat exchangers flows;

a bypass collection flow path extended from an outlet side pipe of at least one of the plurality of heat exchangers to the low pressure flow path; and a bypass valve installed on the bypass collection flow path, wherein during a cooling low load operation in which only a portion of the plurality of heat exchanger is operating, the bypass valve operates to guide a liquid refrigerant loaded in a heat exchanger of the plurality of heat exchangers, which is not operated, through the bypass collection flow path.

2. The air conditioner according to claim 1, wherein during a general cooling operation in which all of the plurality of heat exchangers are operating, the bypass valve is closed so that the liquid refrigerant does not flow into the bypass collection flow path.

3. The air conditioner according to claim 1, wherein during the cooling low load operation, the bypass collection flow path is connected to an outlet side pipe of a non-operating heat exchanger of the plurality of heat exchangers is opened.

4. The air conditioner according to claim 1, further comprising:

a super cooling heat exchanger connected to the outlet side pipe of the plurality of heat exchangers and that exchanges heat after a portion of the refrigerant is branched;

a super cooling flow path through which the branched refrigerant flows, the super cooling flow path being extended to the gas liquid separator; and a super cooling sensor installed on the super cooling flow path.

5. The air conditioner according to claim 1, wherein the plurality of heat exchangers include a first heat exchanger and a second heat exchanger that condense the refrigerant compressed in the at least one compressor, and wherein the second heat exchanger is configured to stop an operation during the cooling low load operation.

6. The air conditioner according to claim 5, wherein the air conditioner further comprises:

a variable flow path that connects an outlet side pipe of the first heat exchanger with an inlet side pipe of the second heat exchanger, and wherein the variable flow path allows selective flow of liquid refrigerant during the cooling low load operation.

7. The air conditioner according to claim 6, wherein the air conditioner further comprises:

a variable valve installed on the variable flow path and that selectively opens and closes the variable flow path.

8. The air conditioner according to claim 7, wherein the plurality of outdoor valves includes a first outdoor valve installed on the outlet side pipe of the first heat exchanger and a second outdoor valve installed on an outlet side pipe of the second heat exchanger, and wherein during the cooling low load operation, the first outdoor valve and the bypass valve are opened, and the second outdoor valve and the variable valve are closed.

* * * * *